United States Patent [19]

Gray et al.

[11] Patent Number: 4,653,397

[45] Date of Patent: Mar. 31, 1987

[54] APPARATUS FOR PACKAGING INSULATION MATERIAL

[75] Inventors: William E. Gray, Granville; Ronald R. Harris, Newark, both of Ohio

[73] Assignee: Owens-Corning Fiberglas Corporation, Toledo, Ohio

[21] Appl. No.: 760,694

[22] Filed: Jul. 30, 1985

[51] Int. Cl.[4] ..... B30B 9/06; B30B 9/24

[52] U.S. Cl. ..... 100/76; 100/118; 53/118; 53/528; 19/296; 19/288; 242/55.1

[58] Field of Search ..... 100/76, 87, 90, 118, 100/130–136, 125; 99/454; 53/118, 528; 242/55.1; 19/290, 296, 288; D7/47

[56] References Cited

U.S. PATENT DOCUMENTS

| | | | |
|---|---|---|---|
| D. 232,801 | 9/1974 | Koblick | D7/47 |
| D. 259,759 | 7/1981 | Williams | D7/47 |
| 828,193 | 8/1906 | Charky | D7/47 X |
| 2,867,843 | 1/1959 | Browne et al. . | |
| 2,984,172 | 5/1961 | Roberts et al. . | |
| 3,401,896 | 9/1968 | Hullhorst | 242/55.1 |
| 3,911,641 | 10/1975 | Miller et al. . | |
| 3,981,047 | 9/1976 | Contractor et al. | 19/296 |
| 4,114,531 | 9/1978 | Plaut . | |
| 4,589,167 | 5/1986 | Bernhardt | 19/296 |

*Primary Examiner*—Peter Feldman

*Attorney, Agent, or Firm*—Ronald C. Hudgens; Greg Dziegielewski; Ted C. Gillespie

[57] ABSTRACT

Apparatus for packaging mineral fiber insulation material includes a compression member to gradually compress the material, where the compression member contains a plurality of depressions, the downstream edge of the depressions being sloped to gradually blend with the plane of the compression surface, and the upstream edge of the depressions forming an abrupt drop from the plane of the compression surface, thereby defining an aperture at the upstream edge of the depressions for the escape of air during compression of the material, where the upstream edge is adapted to support the insulation material during the venting of the compressed air.

9 Claims, 8 Drawing Figures

APPARATUS FOR PACKAGING INSULATION MATERIAL

TECHNICAL FIELD

This invention relates to apparatus for packaging compressible material into a compressed package. In one of its more specific aspects, this invention relates to packs of fibrous mineral insulation material, which are compressed and rolled up into rolls while the compression is maintained. The method and apparatus of this invention are suitable for use in packaging glass fiber insulation material.

BACKGROUND OF THE INVENTION

It is the common practice in the manufacture of insulation materials to carry the insulation on an endless belt, to compress the insulation to a fraction of its former volume, and to deliver the compressed insulation to a packaging machine which can roll up or otherwise package the insulation material. The apparatus used to compress the insulation material in existing applications generally comprises a compression member positioned above the transport conveyor to force the insulation material through a progressively decreasing opening in order for the compression to take place. Typical compression ratios between the initial thickness of the insulation material and the compressed thickness of the insulation material are about 5 to 1, or higher.

One of the problems associated with packaging such compressible material is that frequently the compressed material contains a significant amount of compressed air. The presence of compressed air is the result of the insulation material traveling past the compression member at a rate exceeding the rate at which air can escape during compression. The problem has been magnified by two technological advances of recent years: line speeds have increased significantly, and today's wider and thicker insulation packs prevent a sufficient amount of air from escaping through the sides of the pack. This is in contrast to previous packaging operations for narrower insulation packs.

Compression of insulation packs without permitting escape of the air results in a compressed pack which will expand due to the expansion of compressed air as soon as the confinement is released. This usually necessitates a recompression of the pack in the packaging machine itself. Such recompression is undesirable since each compression cycle of insulation material weakens the material and adversely affects pack recovery. Also, some additional energy is required to recompress the insulation material in the packaging machine if air is not properly vented from the compressible material during the initial compression.

A potential problem is that the pack will travel through the compression apparatus at a rate sufficient to cause the pack to explode or burst out backwards from the entrance of the compression area. Another problem is that the air escapes sideways through the edges of the pack, thereby damaging the pack edges and distorting the pack out of shape.

Attempts have been made to solve the problem of excess compressed air during compression by providing transverse apertures or slits in the compression member for the escape of air. These proved to be inefficient, however, because the slits soon became clogged with loose fibers and binder. If the slits were made wide enough so that they did not clog, the insulation received a washboard treatment as it passed through the compression member, thereby damaging the pack surface.

STATEMENT OF THE INVENTION

Apparatus has now been developed which solves the above problems by providing a compression member having a plurality of depressions, each of which has its downstream edge sloped to gradually blend with the plane of the compression surface, and each of which is adapted to support the insulation material in the plane of the compression surface while venting compressed air.

It has been found that the gradual venting of the air from the insulation material prevents damage to the surface of the insulation material as it passes the upstream edge of the depression. The bulk of the wool is still supported in the plane of the compression surface. The invention prevents a sudden release of support for the wool under conditions in which the wool contains a significant amount of compressed air.

According to this invention, there is provided apparatus for packaging compressible mineral fiber insulation material comprising a conveyor for transporting the insulation material, a compression member positioned above the conveyor and adapted to progressively compress the insulation material, and packaging apparatus for receiving and packaging the compressed insulation material, the compression surface of the compression member containing a plurality of depressions, the downstream edge of the depressions being sloped to gradually blend with the plane of the compression surface, the upstream edge of the depressions forming an abrupt drop from the plane into the depressions, thereby defining an aperture at the upstream edge of the depressions for the escape of air during compression of the insulation material, and the upstream edge being adapted to support the insulation material in the plane as the insulation material passes the upstream portion of the depressions so that compressed air from the insulation material is vented through the aperture while the insulation material is supported in the plane.

In a specific embodiment of the invention, the depressions are narrow at the upstream edge and increase in width in the downstream direction.

In another specific embodiment of the invention, the upstream edge defines a projection pointing in the downstream direction and lying in the plane of the compression surface. Preferably, the projection is curved in the downstream direction, and the upstream portion of the depressions comprises two valleys which are narrow at the upstream edge and increase in width in the downstream direction.

In a preferred embodiment of the invention, the dimensions of the depressions have a machine direction to cross-machine direction ratio within the range of from about 1.3 to about 3.0, and most preferably a ratio of about 2.0.

In a preferred embodiment of the invention, the aperture has a maximum height within the range of from about $\frac{3}{8}$ to about $1\frac{1}{2}$ inches, and most preferably a maximum height of about $\frac{5}{8}$ inches.

DESCRIPTION OF THE INVENTION

This invention will be described in terms of a glass fiber insulation packaging operation, although it is to be understood that the invention can be practiced using packs or compressible strips of other materials, such as insulation packs of mineral materials such as rock, slag or basalt fibers.

Figure 1:
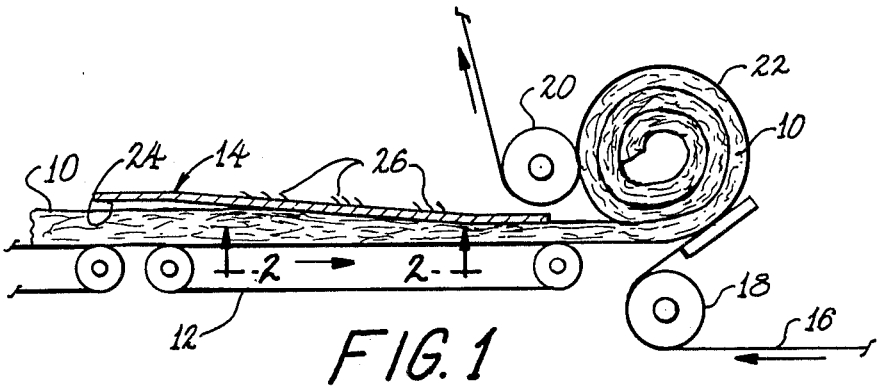
FIG. 1 is a schematic view in elevation of a compression member for compressing insulation material.

As shown in FIG. 1, pack 10 is transported by feed conveyor 12 past compression member 14. The compressed insulation can be packaged by any suitable means, such as by the belt roll-up apparatus shown in FIG. 1. The roll-up belt 16 is supported by drive roll 18 and throat roll 20 to define belt loop 22 in which the compressed insulation is formed into a roll.

. The surface of the compression member which comes into contact and presses against the insulation material, is referred to as compression surface 24. It contains a plurality of depressions, forming protuberances 26 on the back of the compression member. The protuberances define apertures, not shown in FIG. 1, in the depressions to enable compressed air to escape during compression of the insulation material.

Figure 2:
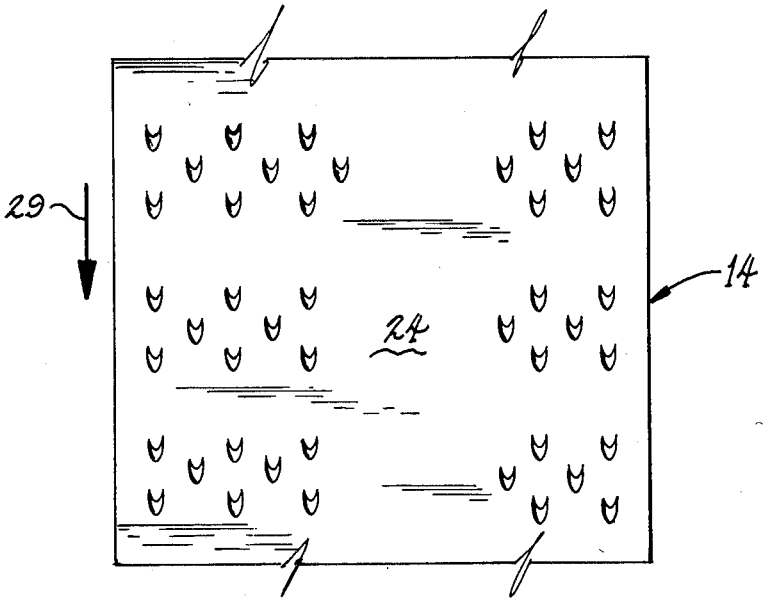
FIG. 2 is a plan view of the compression member along line 2—2 of FIG. 1, showing the depressions of the invention.
Figure 3:
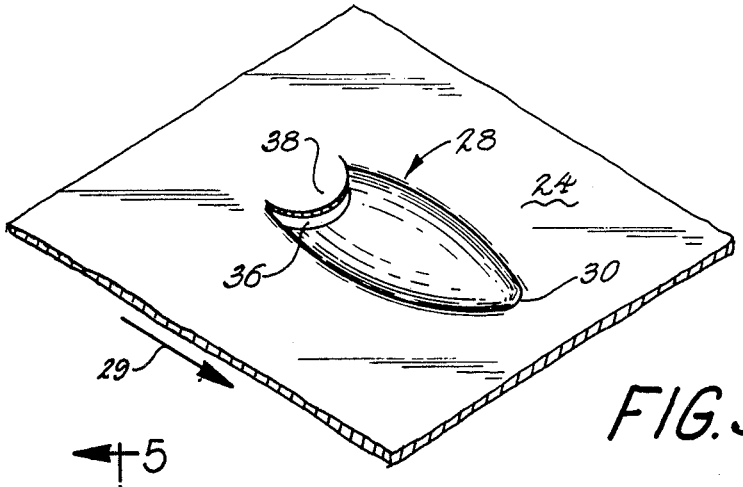
FIG. 3 is a schematic isometric view of a depression of the invention.
Figure 4:
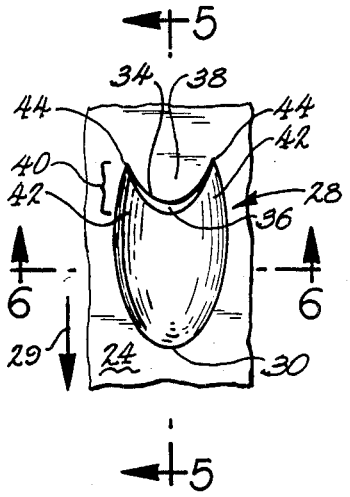
FIG. 4 is a plan view of a depression of the invention.
Figure 5:
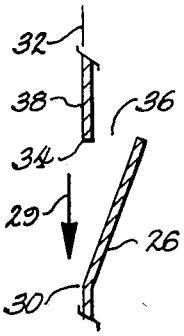
FIG. 5 is a sectional view of the depression, taken along line 5—5 of FIG. 4.

As shown in FIG. 2, the depressions 28 can be arrayed across the width of the compression member as shown. The material flow is in the downward direction, as indicated by arrow 29. The number of depressions in the compression surface can vary, depending upon the throughput of compressed air which must be vented from the material. In the preferred embodiment of the invention, the depressions are punched into a compression member comprised of 14 gauge hot rolled steel, although other materials and means for making the depressions can be employed.

Figure 6:
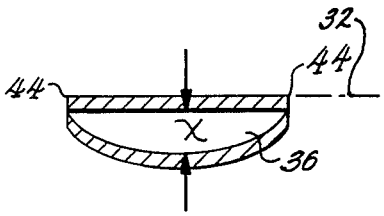
FIG. 6 is a sectional view of the depression, taken along line 6—6 of FIG. 4.

As shown in FIGS. 3–6, the depressions are elongated in the machine direction although they can be of any orientation. Preferably they have a machine direction to cross-machine direction ratio within the range of from about 1.3 to about 3.0. Most preferably, the ratio is about 2.0. Downstream edge 30 of the depressions is sloped to gradually blend with plane 32 of the compression surface. Upstream edge 34 of the depressions forms an abrupt drop from the plane into the depressions. The abrupt drop defines aperture 36, which enables the compressed air to vent. The depressions shown are curvilinear, forming a smooth curve on the bottom, as shown in FIG. 6. Other embodiments of the invention could include depressions having a well-defined V-bottom, in which case the aperture would be triangular in shape, rather than a section of a circle. The maximum height of the aperture, x, shown in FIG. 6 is preferably within the range of from about $\frac{3}{8}$ to about $1\frac{1}{2}$ inches, and most preferably the maximum height is about $\frac{5}{8}$ inches. Apertures with a maximum height that is too low have a tendancy to clog with binder and loose fibers. Apertures with a maximum height that is too high cause deterioration of the insulation material.

The upstream edge 34 of the depression defines projection 38, which can be any shape which supports the insulation while allowing venting of the gases. As the insulation moves past upstream portion 40 of the depression, the projection supports the insulation material in the plane of the compression surface, while allowing some of the compressed air from the insulation material to be vented through the aperture. Preferably, the projection points in the downstream direction. Where the projection is curved in the downstream direction, the depressions would then include two valleys 42 which are narrow at their upstream edge or point 44, and which increase in width in the downstream direction. The valleys would be on either side of the projection. Thus, as the insulation material moves past the upstream portion of the depression, projection 38 supports the insulation material, and the valleys enable a major portion of the compressed air to escape from the insulation material and vent via the aperture. An alternate embodiment of the projection is a screen, not shown, which supports the insulation material in the plane of the compression surface, while enabling compressed air to vent.

Figure 7:
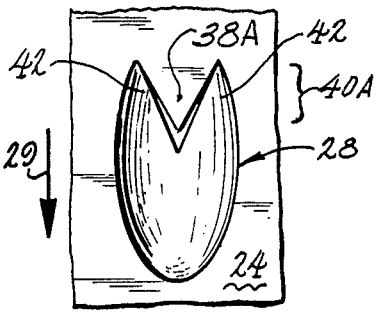
FIG. 7 is a schematic plan view of an alternate embodiment of a depression of the invention.

As shown in FIG. 7, in an alternate embodiment of the Invention the projection 38A is triangular in shape and pointing in the downstream direction. Thus, as the insulation material passes upstream portion 40A of the depression, the insulation material will be supported by the projection and the compressed air can be vented via valleys 42 and through the aperture.

Figure 8:
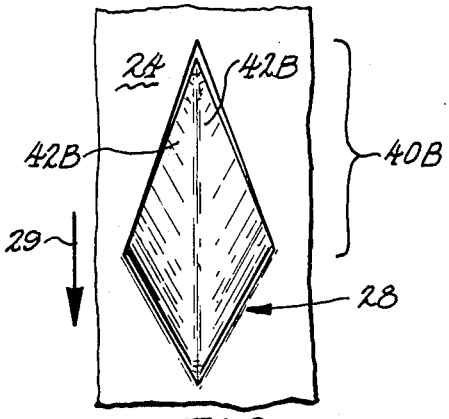
FIG. 8 is a schematic plan view of another embodiment of the invention.

As shown in FIG. 8, in an alternative embodiment, the depression can be adapted with a single valley 42B which is narrow at the upstream edge and increases in width in the downstream direction. Thus, as the insulation material passes the upstream portion 40B of the depression, the insulation material will be supported by the adjacent compression surface 24 while the compressed air is vented through valley 42B and exits via the aperture.

It will be evident from the foregoing that various modifications can be made to this invention. Such, however, are considered as being within the scope of the invention.

INDUSTRIAL APPLICABILITY

This invention will be found to be useful in the packaging of glass fibers for such uses as thermal insulation and acoustical insulation.

We claim:

1. Apparatus for packaging compressible mineral fiber insulation material comprising a conveyor for transporting the insulation material, a compression member positioned above said conveyor and adapted to progressively compress the insulation material, and packaging apparatus for receiving and packaging the compressed insulation material, the compression surface of said compression member containing a plurality of depressions, the downstream edge of said depressions being sloped to gradually blend with the plane of said compression surface, the upstream edge of said depressions forming an abrupt drop from said plane into said depressions, thereby defining an aperture at the upstream edge of said depressions for the escape of air during compression of the insulation material, and said upstream edge being adapted to support the insulation material in said plane as the insulation material passes the upstream portion of said depressions so that compressed air from the insulation material is vented through said aperture while said insulation material is supported in said plane.

2. The apparatus of claim 1 in which said depressions are narrow at said upstream edge and increase in width in the downstream direction.

3. The apparatus of claim 1 in which said upstream edge defines a projection pointing in the downstream direction and lying in said plane.

4. The apparatus of claim 3 in which said projection is curved in the downstream direction.

5. The apparatus of claim 4 in which the upstream portion of said depressions comprises two valleys which are narrow at their upstream edge and increase in width in the downstream direction, said valleys being on either side of said projection.

6. The apparatus of claim 3 in which the dimensions of said depressions have a machine direction to cross-machine direction ratio within the range of from about 1.3 to about 3.0.

7. The apparatus of claim 6 in which said ratio is about 2.0.

8. The apparatus of claim 3 in which said aperture has a maximum height within the range of from about $\frac{3}{8}$ to about $1\frac{1}{2}$ inches.

9. The apparatus of claim 8 in which said aperture has a maximum height of about $\frac{5}{8}$ inches.

* * * * *